US005841233A

United States Patent [19]

Ury et al.

[11] Patent Number: 5,841,233

[45] Date of Patent: Nov. 24, 1998

[54] METHOD AND APPARATUS FOR MOUNTING A DICHROIC MIRROR IN A MICROWAVE POWERED LAMP ASSEMBLY USING DEFORMABLE TABS

[75] Inventors: Michael Ury, Bethesda; Frank Sowers, Frederick; Curt Harper, Wheaton; Wayne Love, Olney, all of Md.

[73] Assignee: Fusion Lighting, Inc., Rockville, Md.

[21] Appl. No.: 592,475

[22] Filed: Jan. 26, 1996

[51] Int. Cl.[6] ..... H01J 65/04

[52] U.S. Cl. ..... 315/39; 315/248

[58] Field of Search ..... 315/39, 248, 267, 315/394; 313/113; 362/433, 457

[56] References Cited

U.S. PATENT DOCUMENTS

| | | | |
|---|---|---|---|
| 4,673,846 | 6/1987 | Yoshizawa et al. | 315/248 |
| 4,954,755 | 9/1990 | Lynch et al. | 315/248 |
| 5,039,918 | 8/1991 | Ohtake et al. | 315/248 |
| 5,227,698 | 7/1993 | Simpson et al. | 315/248 |
| 5,334,913 | 8/1994 | Ury et al. | 315/248 |
| 5,404,076 | 4/1995 | Dolan et al. | 313/572 |

FOREIGN PATENT DOCUMENTS 0153745 5/1991 European Pat. Off. .

*Primary Examiner*—Benny T. Lee
*Attorney, Agent, or Firm*—Epstein, Edell and Retzer

[57] ABSTRACT

A microwave powered electrodeless lamp includes an improved screen unit having mesh and solid sections with an internal reflector secured at the juncture of the two sections to reflect light into a light-transmitting chamber defined in the lamp microwave cavity by the reflector and the mesh section. A discharge envelope of a bulb is disposed in the light-transmitting chamber. Light emitted from the envelope is prevented by the reflector from entering the cavity portion bounded by the solid section of the screen. The reflector is mounted in the cavity by tabs formed in the screen unit and bendable into the cavity to define support planes abutting respective surfaces of the reflector. The mesh section and tabs are preferably formed by etching a thin metal sheet.

16 Claims, 4 Drawing Sheets

METHOD AND APPARATUS FOR MOUNTING A DICHROIC MIRROR IN A MICROWAVE POWERED LAMP ASSEMBLY USING DEFORMABLE TABS

This invention was made with Government support under Contract No. DE-FG01-95EE23796 awarded by the Department of Energy. The Government has certain rights in this invention.

BACKGROUND OF THE INVENTION

1. Technical Field

The present invention pertains generally to microwave powered lamps and, more specifically, to improvements in methods and apparatus for mounting optical reflectors in microwave cavities defined by a screen structure employed to transmit light while retaining microwave energy.

2. Discussion of the Prior Art

Lamps utilizing radio frequency (RF) energy to excite electrodeless bulbs are well known. Examples of such lamps may be found in U.S. Pat. Nos. 4,954,755 (Lynch et al), 5,227,698 (Simpson et al), 5,334,913 (Ury et al) and 5,404,076 (Dolan et al). The disclosures in all of these patents are expressly incorporated herein. In lamps of this type microwave energy is coupled from a magnetron or other RF source to the lamp bulb via a coupling circuit including a waveguide and a quasi-resonant cavity typically defined, at least in part, by a screen unit. The waveguide functions as an impedance matching device from the source to the cavity.

Prior art screen structures used in microwave powered lamps are disclosed in numerous prior patents as represented by the above-mentioned Lynch et al, Simpson et al, Ury et al and Dolan et al patents, and in European Patent Specification 0 153 745 (Yoshizawa et al). Such screens typically surround a bulb envelope and serve to allow optical radiation from the bulb to escape while forming a conductive enclosure blocking escape of RF energy. Screen design has generally involved an inherent compromise between these factors. Specifically, screens having very low optical loss tend to permit escape of undesirably large amounts of RF radiation. On the other hand, elimination of RF radiation generally incurs the penalty of diminishing optical transmission through the screen.

A recent development in screen structure is disclosed in U.S. patent application Ser. No. 08/592,474, filed contemporaneously herewith by Brian Turner and Michael Ury and entitled "Microwave Container Screens for Electrodeless Lamps" (attorney docket FUS961). The entire disclosure from that patent application is incorporated herein by reference. The screen structure disclosed in the Turner and Ury patent application includes a metal mesh section and a metal solid section. The mesh section is transmissive to light and non-transmissive to microwave energy at the operating frequency. The solid section is non-transmissive to both light and microwave energy. In this regard, the term "solid" as used herein is intended to distinguish from the mesh section and connotes the absence of gaps or breaks in the structure. The mesh section has a right cylindrical configuration with a mesh end cap at one end, and the solid section is configured as a right cylindrical section of like diameter extending coaxially from the opposite end of the mesh section. A reflector, in the form of an electrically non-conductive circular disk, has its annular edge secured at the annular juncture between the mesh and solid sections, and is disposed coaxially with both of these sections with its reflective surface facing into the mesh section. The reflector thus defines an optically isolated light transmission chamber within the microwave cavity. An electrodeless bulb has its discharge envelope disposed within the light transmitting cavity surrounded by the mesh section. The reflector is centrally apertured to permit passage of the bulb stem through the space bounded by the solid section of the screen unit.

The screen unit is fabricated from two members, the first of which is a single thin rectangular sheet of stainless steel that is etched to provide the desired mesh pattern. The sheet is rolled into a cylinder to form the screen member containing both mesh and solid sections.

The reflector is essentially a mirror made from fused silica coated with a metal oxide dichroic coating which does not absorb microwave energy. The mirror can be mounted in various positions in the cavity depending upon the optical design. Once mounted it must retain its position regardless of orientation to gravity, shocks experienced during shipping or operation and continued vibration over many years of use. The mirror is subjected to very high temperatures because it is disposed adjacent a bulb operating at temperatures in excess of 800° C. and emitting over 600 watts of radiation. Any mirror mounting system must not absorb microwaves or add dielectric volume to the cavity, and must be able to withstand a high temperature (e.g., 300°–500° C.) environment.

The reflector described in the aforementioned Turner and Ury patent application is held in place with a high temperature cement called Saurereisin™ brand cement a white hard cement which adheres reasonably well to glass and to the stainless steel screen material. Three or four dabs of cement are placed around the edge of the reflector glass where it touches the screen material. This technique works reasonably well but requires fixturing the mirror in place while the cement dries, usually an overnight procedure. The process tends to be messy and labor intensive in order to put the right amount of cement on the reflector edge. In addition, the technique is subject to occasional bond failures.

OBJECTS AND SUMMARY OF THE INVENTION

It is therefore an object of the present invention to provide a method and apparatus for quickly, inexpensively and reliably mounting a reflector in a microwave cavity formed by a thin metal screen unit used in a microwave powered electrodeless lamp.

In accordance with the present invention, an optical reflector is secured in place between two rows of bendable tabs or other members defined in a cavity-forming screen of the type disclosed in the Turner and Ury patent application. Specifically, the screen unit, which is made from a thin sheet of etched stainless steel, has the desired tab patterns etched into the metal sheet preferably at the same time the mesh portion of the screen is etched. The tabs are defined by etching generally U-shaped cut-outs in the metal sheet. Upper tabs, defined in an annular row at circumferentially spaced tab locations, are adapted to be bent downward out of the plane of the sheet at an angle of 90° so as to extend radially inward of the cylindrical screen unit. The reflector, typically in the form of a circular disk, is inserted through the bottom of the cylindrical screen against the bent upper tabs. Lower tabs, defined in an annular row at positions circumferentially spaced about the screen periphery, are then bent upward to engage the reflector in place between the two rows to tabs. The spacing between the two rows is substantially equal to the thickness of the reflector disk.

Bending of the upper tabs downward can be effected by a fixture placed inside the cylindrical screen to ensure a sharp 90-degree bend. The tabs themselves are rounded at their distal ends to minimize any field enhancement that might be caused by the radial projection of the metal. In addition, the tabs must be sufficiently short to avoid coupling of energy from the microwave field in order to prevent arcing from the tab edges.

Multiple rows of tabs can be defined in the screen in order to provide several alternative positions for the reflector. The tabs may be formed in either the mesh pattern or the solid pattern of the screen unit. As an alternative to tabs, any members defined in the screen and capable of being projected into the cavity may be utilized to mount the reflector.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DESCRIPTION OF THE PREFERRED EMBODIMENTS

Figure 1:
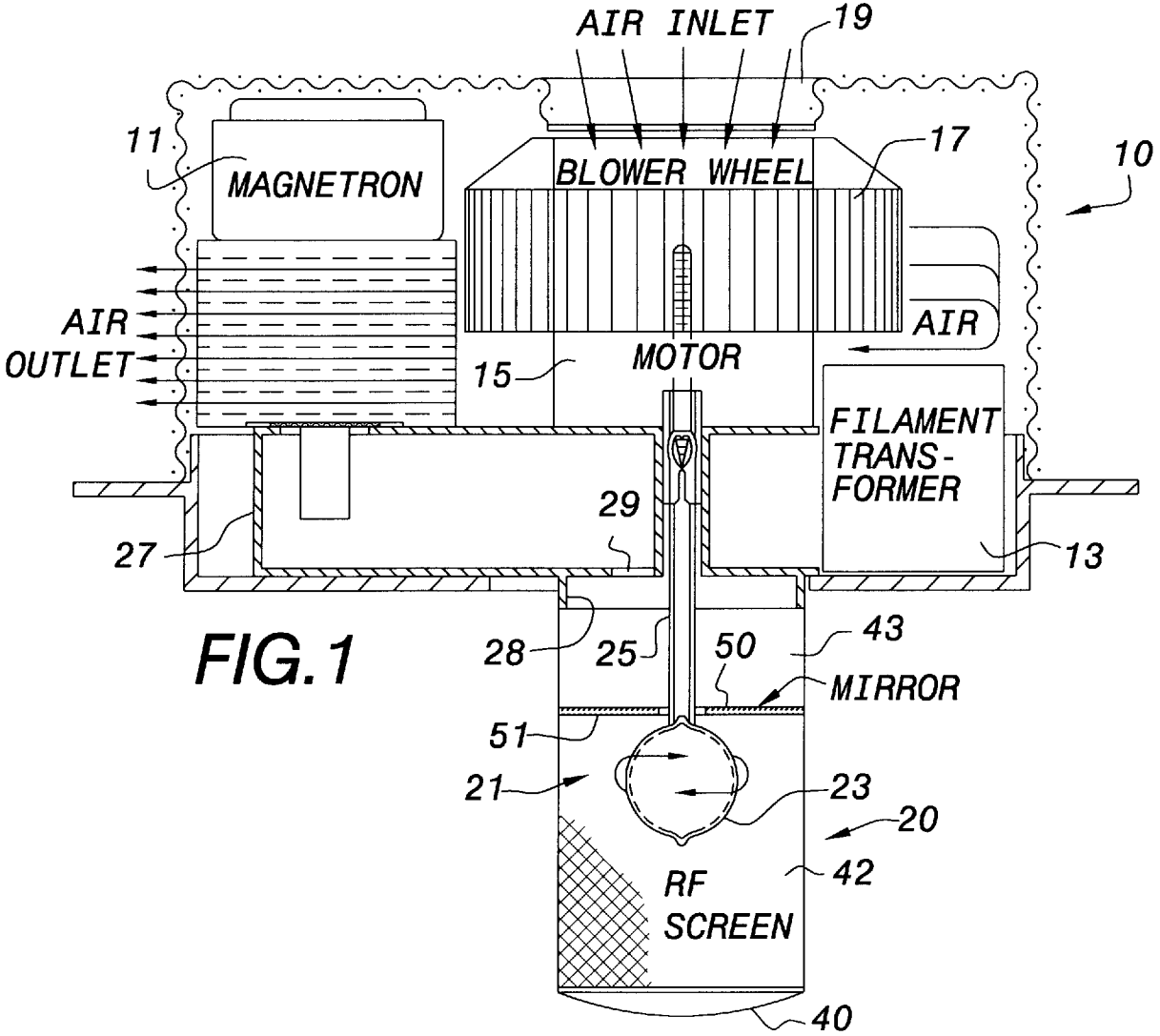
FIG. 1 is a partially diagrammatic view in longitudinal section of a lamp assembly employing a screen unit employing to the principles of the present invention.

Referring specifically to FIG. 1, a lamp assembly using the screen unit of the present invention includes a lamp module 10 comprising a housing for a magnetron 11 or other microwave source, a filament transformer 13 supplying filament current to the magnetron 11, and a motor 15 for rotating a bulb and for driving a cooling fan in the form of blower wheel 17. An air inlet 19 is defined in one end of the housing, and blower wheel 17 causes air to flow through the lamp module 10 to an air outlet, as shown in FIG. 1.

A screen assembly 20 defines a microwave cavity wherein a bulb 21 is disposed. Bulb 21 includes a generally spherical discharge envelope 23 (also shown in FIG. 3) supported at the end of an elongate cylindrical stem 25. Stem 25 is secured to a drive shaft 27 of a motor 15 to permit the bulb 21 to be rotated about the longitudinal axis of its stem 25. Bulb 21 has a high pressure fill material contained in its discharge envelope 23 such as, for example, the material described in the above-referenced Dolan et al patent. The bulb is made of quartz or other suitable material.

Microwave energy generated by magnetron 11 is fed by a waveguide 27 to a coupling slot 29 providing ingress to the microwave cavity defined by screen unit 20.

Figure 2:
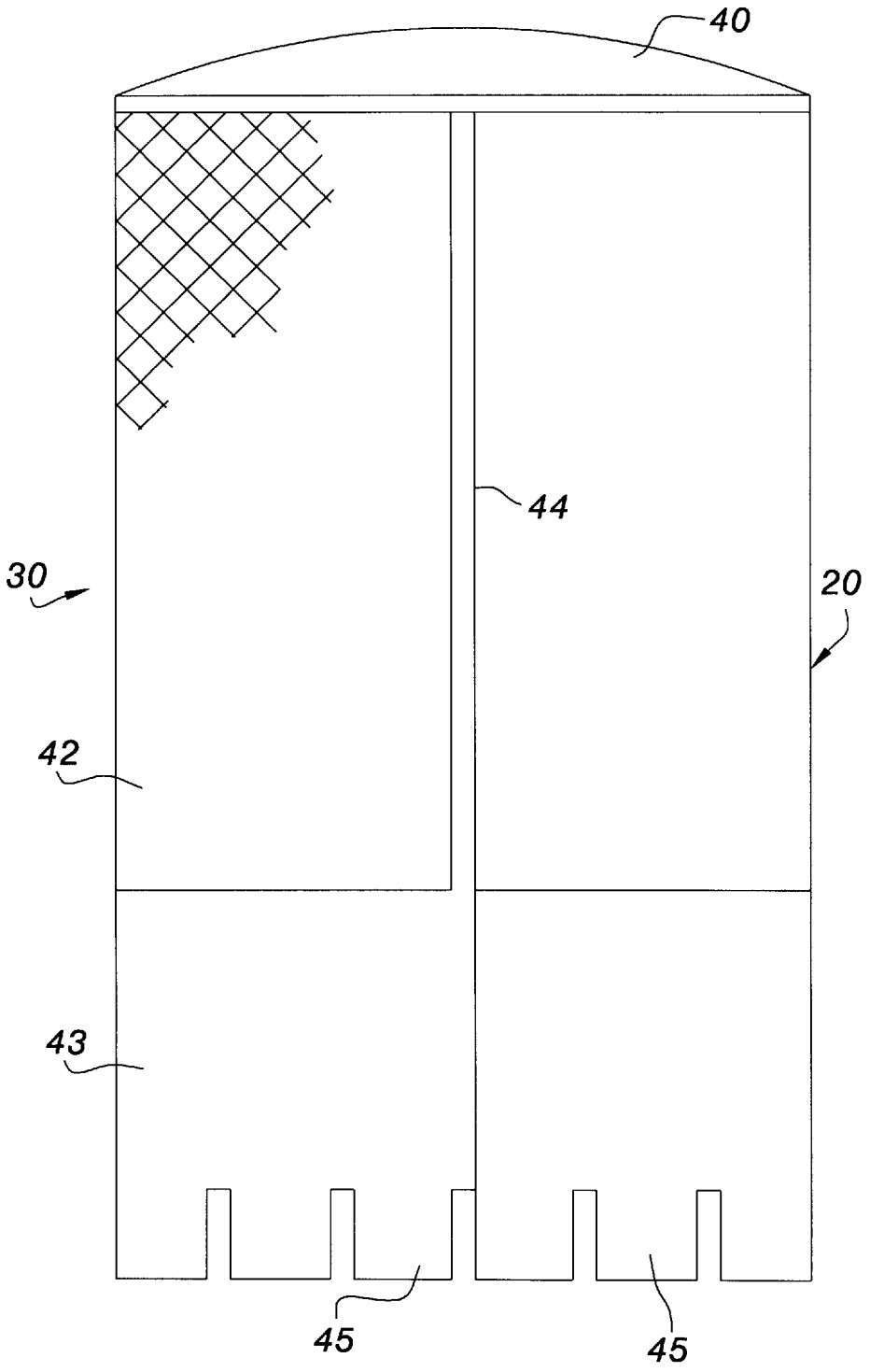
FIG. 2 is a side view in elevation of the screen unit used in the assembly of FIG. 1.
Figure 5:
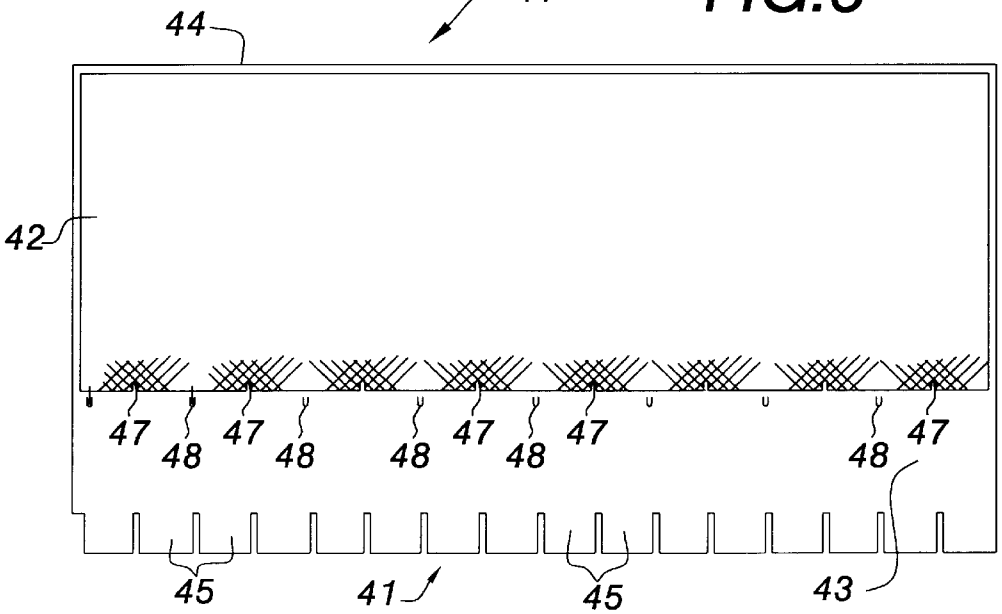
FIG. 5 is a top view in plan of an etched metal sheet used to form the screen assembly of FIG. 2.
Figure 3:
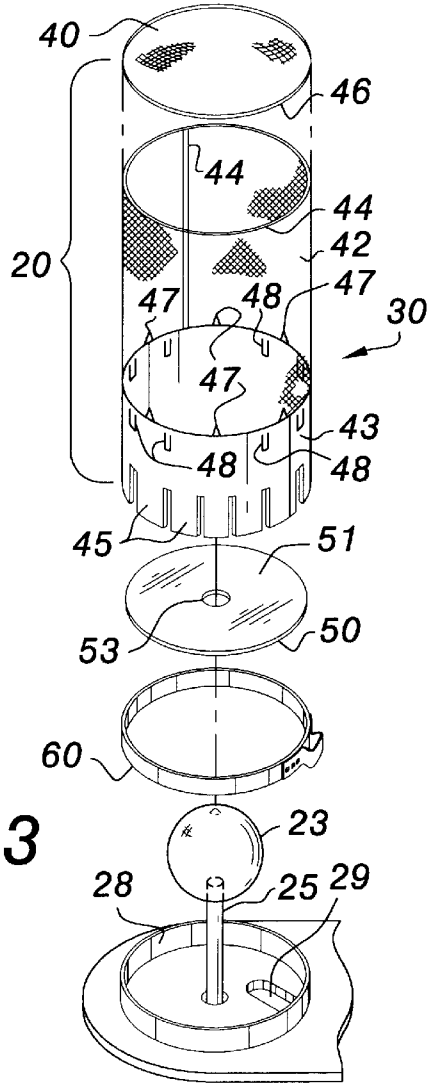
FIG. 3 is an exploded view in perspective of a portion of the screen unit of FIG. 1 showing the manner in which the internal reflector is inserted into the screen unit.
Figure 6:
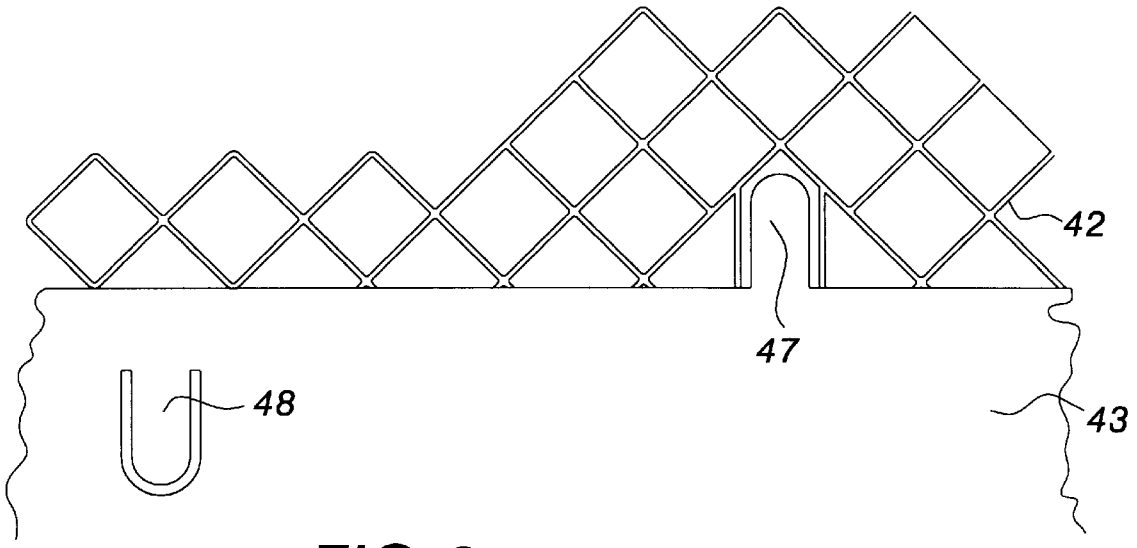
FIG. 6 is a detailed top view in plan of a portion of the sheet of FIG. 5.

The screen unit 20 of the preferred embodiment is made from two members, namely a right cylindrical member 30 and an end cap 40 (see FIGS. 1–3). Each of these two members is formed as a respective one-piece unit. Specifically, cylindrical member 30 is formed from a single sheet 41 (see FIG. 5) of metal that has been etched to provide a metal mesh section 42 and a contiguous metal solid section 43 (see FIGS. 1–5, also denoted by "RF SCREEN" in FIG. 1). In addition, an upper row of mounting tabs 47 and a lower row of mounting tabs 48 are etched into sheet 41 simultaneously with the etching of mesh section 42 (see FIGS. 4 and 5). In the preferred embodiment the upper tabs 47 are defined in mesh section 42 whereas the lower tabs 48 are defined in solid section 43. As seen in FIG. 6, the tabs are generally U-shaped and co-planar with sheet 41, and are defined by etching a U-shaped slot through sheet 41 about each tab location. The upper tabs 47 extend upwardly while the lower tabs 48 extend downwardly. Typically, right tabs are defined in each row at equally spaced circumferential locations about screen unit 20 with the tabs in each row being offset circumferentially from the tabs in the other row. In the preferred embodiment each tab 47 is located circumferentially midway between tabs 48.

An imaginary circumferential line joining the roots or bases about which tabs 47 are bendable is longitudinally spaced from a similar imaginary line joining the base of tabs 48. The spacing is selected to match the thickness of a reflector 50 (see FIGS. 1, 3, 4; also denoted by "MIRROR" in FIG. 1) described below.

Preferably, sheet 41 is a stainless steel sheet having a thickness between 0.003 and 0.005 inches. Mesh section 42 and tabs 47, 48 are etched through the sheet, the etching pattern preferably being controlled by computer so that virtually any location of the tabs and mesh section or sections and any pattern and size of the tabs and the interstices of the mesh can be provided. The size and pattern of the interstices are selected to minimize transmission of RF energy through the conductive mesh. As shown in FIG. 5, in the preferred embodiment mesh section 42 and solid section 43 are formed in sheet 41 as adjacent or contiguous rectangular sections meeting at a straight line juncture corresponding to the abutting inboard edges of these two sections. The rows of tabs 47, 48 are defined on opposite sides of this juncture. The three outer edges of mesh section 42 are bounded by a very narrow solid metal border or strip 44 (see FIG. 5) formed as a continuance of solid metal section 43. The longer outer edge of solid section 43 has multiple slots etched therethrough and extending perpendicular to that edge toward mesh section 42. These slots define multiple finger-like members 45 which, because of the thinness of the material of sheet 41 and the spacing of the slots, are individually compliant to facilitate attachment of the screen unit to the assembly in the manner described below.

As seen in FIGS. 2 and 3, during assembly sheet 41 is rolled into a right circular cylinder such that mesh and solid sections 42 and 43 form respective adjacent cylindrical sections for the resulting screen unit 20. In order to maintain the final cylindrical form of the rolled sheet, opposite edges of the sheet are slightly overlapped, i.e., by the width of border 44 (see FIG. 3), and then secured together by any suitable means such as adhesive, welding, etc. In the resulting cylinder 30, the end comprising fingers 45 defined in solid section 43 is referred to herein as the proximal end of the cylinder; the opposite end, bounded by the annular portion of border 44 of mesh section 42, is referred to herein as the distal end.

As shown in FIG.3, end member 40 is a substantially circular mesh member formed from the same material and by the same process as cylindrical member 30. The mesh end member 40 is circumferentially bounded by a solid border 46. Border 46 and the annular portion of border 44 of cylinder 30 are joined together by crimping, welding or other suitable technique to provide a mesh closure at the distal end of the cylinder.

Figure 4:
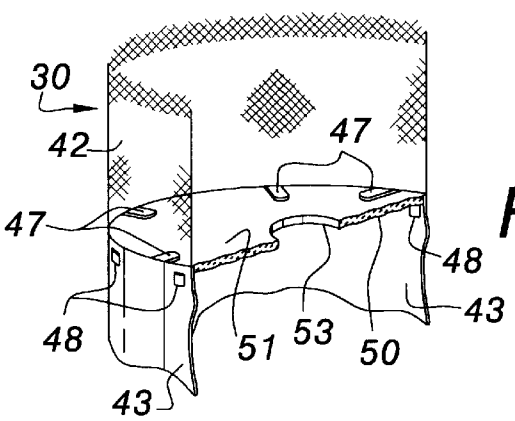
FIG. 4 is a broken detailed view in perspective of a portion of the screen assembly of FIG. 3 showing the manner of mounting a reflector in the screen assembly in accordance with the present invention.

As best illustrated in FIGS. 3 and 4, a reflector 50 takes the form of a circular disk having an outside diameter substantially equal to the inside diameter of cylindrical member 30. Reflector 50 is typically made from fused silica and has at least one surface 51 (see FIGS. 1,2,3,) with an optically reflective metal oxide coating which does not absorb microwave energy. A small centrally located aperture 53 is defined in reflector 50 and is of sufficient size to permit stem 25 of the bulb 21 to pass therethrough. Reflector 50 is positioned coaxially within the microwave cavity at a location corresponding to the annular juncture of mesh section 42 and solid section 43. In this manner reflector 50 effectively defines an optically isolated light transmission chamber by optically closing off the proximal end of mesh section 42 from the remainder of the microwave cavity without affecting the quasi-resonant characteristics of the overall cavity at the operating microwave frequency. Attachment of reflector 50 to the cylinder is achieved according to the present invention in the manner described immediately below.

In order to mount reflector or mirror 50 in the microwave cavity, the upper tabs are each bent 90° downward and inward about their bases so as to project radially into the cavity and define a first support plane. This bending can be by hand but is preferably done by using a suitable fixture placed inside the screen to assure a sharp 90-degree bend. Reflector 50 is then inserted through the bottom opening of screen unit 20 (i.e., through the opening at the proximal end of the unit where solid section 43 is located). The reflector disk, having an outer diameter corresponding to the inner diameter of screen unit 20, is thus able to be seated with its top reflective surface against the bent upper tabs 47. The lower tabs are then bent 90° upward and inward about their bases so as to project radially into the cavity and against the bottom surface of reflector 50, thereby defining a second reflector support plane. The spacing between the two support planes substantially corresponds to the thickness of reflector 50.

The screen unit is secured to the lamp assembly 10 (see FIGS. 1 and 3) by disposing fingers 45 circumferentially about an annular flange 28 extending from the assembly housing. The compliance inherent in the finger structure facilitates this placement. An annular hose clamp 60 (FIG. 3) may then be placed circumferentially about the fingers and then tightened by radial contraction to secure the fingers to the flange 28. Coupling slot 29 from the waveguide is located radially inward of flange 28 so that the microwave energy from magnetron 11 can be delivered into the microwave cavity defined by screen unit 20, as seen in FIG. 1.

As best seen in FIG. 1 in the assembled unit the bulb discharge envelope 23 is disposed in the optically isolated optical transmission chamber of the microwave cavity defined circumferentially by cylindrical mesh section 42 and at its ends by reflector 50 and end cap 40. Bulb stem 25 extends through aperture 53 in reflector 50 into the opaque chamber bounded by solid section 43, and then through a suitably provided bore in the lamp assembly housing where the stem is engaged by a rotatable drive shaft of motor 15 to permit rotation of the bulb about the stem axis. As is conventional, one of the effects produced by rotation of the bulb in this manner is the cooling of the bulb discharge envelope 23 in the microwave cavity.

Microwave energy entering the cavity defined by screen unit 20 via coupling slot 29 excites the fill in discharge envelope 23 resulting in light energy being emitted from the envelope. Reflective surface 51 prevents the light from entering the region of the microwave cavity bounded by solid section 43 of the cylindrical member 30. Instead, light impinging upon surface 51 is reflected out of the cavity through the interstices in mesh section 42 and end cap 40. Reflector 50, and in particular reflective surface 51, may be contoured as desired (e.g., concave, convex, etc.) to reflect light in preferential directions through the mesh. Clearly, substantially all of the light energy is prevented from passing into the region bounded by the solid section of the cylinder, thereby permitting the light to be most efficiently transmitted out through the interstices of the mesh material. Since the portions of the microwave cavity boundary wall through which light transmission is not desired are solid, the overall RF leakage through the screen unit is greatly reduced from that of an all mesh screen unit.

In an exemplary embodiment of the present invention, a stainless steel sheet 41 is rectangular in shape and has a thickness of 0.102 mm. The length and width of the sheet are 237.13 mm and 125.73 mm respectively. The width of solid section 43 is 41.91 mm, and the width of mesh section 42 is 83.82 mm. Edge border 44 is 1.52 mm wide. Fingers 45 are sixteen in number, extend 10.0 mm into solid section 43 from the edge of sheet 41, are separated by 1.3 mm wide slots and are 13.4 mm wide. Tabs 47 and 48 are 1.27 mm wide and 2.54 mm long, and their defining U-shaped slots are 0.25 mm wide throughout their U-shaped length. The spacing between tabs 47 in the top row, and between tabs 48 in the bottom row is 30.2 mm. The spacing between the bases of the rows of tabs (i.e., longitudinally along the cylinder) is 1.65 mm. It is to be understood that these dimensions are provided by way of example only and are not in any way limiting on the scope of the invention.

The length of tabs 47 and 48 must be limited to prevent them from coupling energy from the microwave field established in the cavity. Such coupling could lead to arcing from tab edges. The 2.54 mm exemplary tab length stated above is considerably shorter than the wavelength of a typical operating frequency of 2.45 Ghz and has proven to be a satisfactory choice for the described embodiment.

In mounting the reflector it may not be necessary to bend all of the tabs into the cavity. For example, only alternate tabs in either or both rows may be deployed in certain instances, thereby further reducing the likelihood coupling energy from the microwave field.

Figure 7:
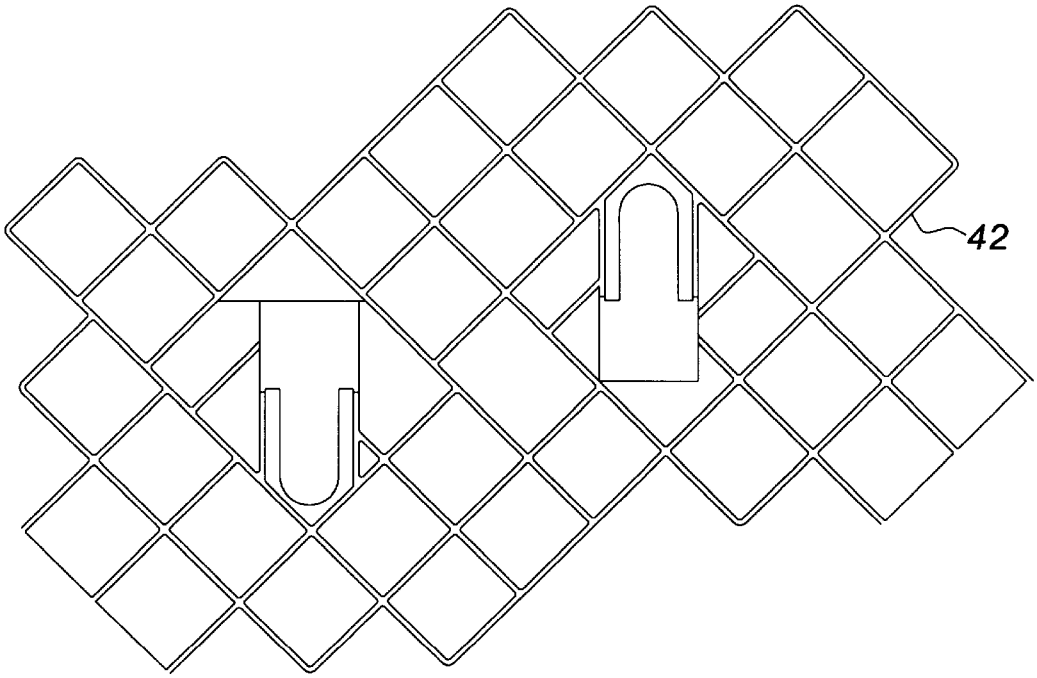
FIG. 7 is a detailed top view in plan of a portion of an alternative sheet configuration used to form a screen assembly of the present invention.

It will be appreciated that more than two rows of support tabs may be etched into sheet 41, thereby providing alternative longitudinal mounting locations for a reflector in the cavity. Moreover, the "rows" need not be defined in straight lines across sheet 41 or parallel to the edges of that sheet, depending, of course, on the configuration of the reflector to be mounted in the microwave cavity. In addition, a pair of supporting tab rows need not be located at the junction of solid section 43 and mesh section 42. Thus, for example, the cooperating tab rows may both be defined in a mesh section 42 as illustrated in FIG. 7.

As noted above, the cylindrical member of the screen unit is preferably fabricated by selectively etching the desired mesh and tab patterns and in a sheet of metal. It will be appreciated that the mesh pattern can easily take any shape consistent with the desired light transmission pattern for the lamp assembly. Of course, the configuration of the reflector can also be changed to provide such light transmission pattern, thereby determining the location and pattern of mounting tab groups. It will be appreciated, therefore, that the cylindrical member 30 can be etched or otherwise formed with any combination of tab patterns and mesh and solid sections from one sheet of metal. By appropriately locating one or more reflectors in the resulting microwave cavity, the optically transmissive chamber of the cavity can be optically isolated from the remainder of the cavity, thereby minimizing RF leakage while optimizing light transmission.

Although the screen unit for the preferred embodiments illustrated herein includes a substantially cylindrical member, it will be appreciated that the microwave cavity, in some instances, need not be cylindrical. In this regard, the same techniques described hereinabove may be utilized to provide screen units having rectangular, polygonal, oval, or other transverse cross-sections, and the tab patterns for mounting suitable reflectors will change accordingly.

The tabs may be used to support a reflector in other types of screens, not only screens having mesh and solid sections etched or otherwise formed in the same sheet. For example, where the screen unit is entirely mesh, the tab approach described herein is equally applicable. Likewise, although tabs constitute the preferred reflector support structure, such structure need not take the form of tabs. Substantially any inwardly projectable deformable portion of a screen unit may be used to mount the reflector. For example, two annular portions of a screen, either mesh or solid, may be radially compressed inward and deformed to define an annular recess for receiving and supporting a reflector. Similarly, portions of the screen may be projected radially outward to define an annular pocket to receive a reflector. Whichever alternative is used, the important feature is that the reflector support structure is formed as part of the same one-piece member in which the mesh is etched or otherwise defined.

It will also be appreciated that the use of built-in tabs or other deformable members to support a reflector as described herein is not limited to the particular etched screen structures disclosed herein. Rather, the reflector mounting techniques of the present invention are useful and adaptable to a wide variety of prior art screen units in which the deformable member can be formed. See, for example, the Lynch et al, Simpson et al and Ury et al patents referred to hereinabove.

From the foregoing description, it will be appreciated that the invention makes available a novel mounting arrangement for a reflector in a screen unit for electrodeless lamps wherein reflector mounting tabs and mesh and solid sections may be defined in a single member used to form the body of a microwave cavity, whereby a reflector can be easily, reliably and inexpensively mounted at a location to optically isolate a light transmission chamber from the remainder of the microwave cavity while reducing microwave energy leakage from the cavity.

Having described preferred embodiments of a new and improved method and apparatus for mounting a mirror in a microwave powered lamp, it is believed that other modifications, variations and changes will be suggested to persons skilled in the art in view of the teachings set forth herein. Accordingly, it is to be understood that all such variations, modifications and changes are believed to fall within the scope of the present invention as defined by the appended claims.

What is claimed is:

1. A microwave powered lamp comprising:

a source of microwave energy;

a microwave cavity having a one-piece peripheral boundary wall including a solid wall section substantially impervious to light and to said microwave energy, and a mesh wall section transmissive to light and not transmissive to said microwave energy;

an electrically non-conductive light reflector disposed at a predetermined location within said cavity to subdivide said cavity into first and second chambers, said first chamber including said solid section of said peripheral boundary wall, said second chamber including said mesh section of said peripheral boundary wall, wherein said reflector optically isolates said second chamber and blocks light transmission between said chambers;

mounting means for securing said reflector at said predetermined location comprising first and second rows of tabs defined in said peripheral boundary wall, said tabs extending inwardly of the cavity such that each row of tabs contacts a respective surface of, and defines a respective support plane for, said reflector;

a discharge envelope containing material therein excitable by said microwave energy to the point of emitting light therefrom, said discharge envelope being maintained in said second chamber such that light emitted therefrom is transmitted through said mesh section both directly from said envelope and as reflected light from said reflector; and coupling means directing said microwave energy from said source into said cavity to excite said material in said discharge envelope.

2. The lamp of claim 1 further comprising a drive motor for rotating said discharge envelope, wherein said discharge envelope is supported on a stem extending through said reflector, into and through said first chamber, and into rotatable engagement with said motor.

3. The lamp of claim 1 wherein said peripheral boundary wall is a one-piece sheet of metal through which said mesh section and said tabs are defined.

4. The lamp of claim 3 wherein said mesh section comprises multiple interstitial openings etched through said sheet, and said tabs comprise respective U-shaped solid members defined by surrounding etched U-shaped slots through said sheet.

5. The lamp of claim 4 wherein said solid and mesh sections comprise adjacent cylindrical sections meeting at an annular juncture, and wherein said first and second rows of tabs are located on opposite sides of said juncture and spaced by a distance substantially equal to a thickness dimension of said reflector.

6. The lamp of claim 4 wherein said tabs each have a respective length that is shorter than the wavelength associated with said microwave energy.

7. A microwave powered lamp comprising:

a microwave cavity having a boundary wall comprised of a metal sheet having at least a mesh section and deformable members defined in said metal sheet;

coupling means for delivering microwave energy to said cavity;

a discharge envelope mounted in said cavity and containing fill material therein responsive to excitation by microwave energy applied thereto for emitting light therefrom; and an electrically non-conductive reflector;

mounting means for mounting said reflector in said cavity to define an optically isolated light-transmitting chamber in said cavity wherein said reflector is positioned to reflect said light emitted from said envelope into said chamber and out through said mesh section, said mounting means comprising said deformable members deformed radially to define respective support planes in which said deformable members engage opposite surfaces of said reflector.

8. The lamp of claim 7 wherein said deformable members comprise at least two rows of bendable tabs, and wherein said mounting means comprises said tabs bent radially inward such that said two rows define said respective support planes.

9. The lamp of claim 7 further comprising an optically non-transmissive solid section defined in said boundary wall, wherein said mesh section and said solid section meet at a juncture, and wherein said reflector is secured at said juncture to define said light-transmitting chamber between said mesh section and said reflector, leaving a remainder of said cavity bounded by the optically non-transmissive solid section and said reflector, wherein said support planes are spaced on opposite sides of said juncture.

10. The lamp according to claim 7 wherein said mesh section and deformable members are etched in said sheet.

11. In a microwave powered electrodeless lamp of the type having a discharge envelope disposed in a microwave cavity and containing fill material therein responsive to microwave energy for emitting light therefrom, a method of mounting an optical reflector in said cavity comprising the steps of:

(a) forming a mesh pattern and at least first and second rows of deformable portions through parts of a thin metal sheet to define adjacent mesh and solid sections in said sheet with a juncture between said sections;

(b) securing opposite edges of said sheet to one another to form a peripheral enclosure for said cavity, wherein the enclosure includes an optical transmission chamber;

(c) disposing said discharge envelope in said optical transmission chamber;

(d) securing an electrically non-conductive light reflector in said cavity to reflect said light into said optical transmission chamber enclosing said discharge envelope and bounded by said reflector and said mesh sections, said step of securing comprising the steps of;

(d.1) bending said deformable portions of said first row to project into said cavity and define a first support plane for said reflector;

(d.2) bending said deformable portions of said second row to project into said cavity and define a second support plane; and (d.3) placing the reflector in said cavity between said first and second support planes in supported contact with said first and second rows of deformable portions.

12. The method of claim 11 wherein step (a) includes etching said mesh pattern and said deformable portions through said sheet.

13. The method of claim 11 wherein said deformable portions are tabs and wherein, in step (d), said tabs are bent at respective angles to contact a corresponding surface of said reflector.

14. A microwave powered lamp comprising:

a source of microwave energy;

a microwave cavity having a one-piece boundary wall including a mesh wall section transmissive to light and not transmissive to said microwave energy;

a light reflector disposed at a predetermined location within said cavity;

first and second inwardly projectable deformable portions defined in said peripheral boundary wall, said inwardly projectable deformable portions extending into the cavity such that each inwardly projectable deformable portion contacts a respective surface of, and defines a respective support plane for, said reflector;

a discharge envelope containing material therein excitable by said microwave energy to emit said light therefrom, said discharge envelope being maintained in said cavity such that light emitted therefrom is transmitted through said mesh section both directly from said envelope and as reflected light from said reflector; and coupling means directing said microwave energy from said source into said cavity to excite said material in said discharge envelope.

15. In a microwave powered electrodeless lamp of the type having a discharge envelope disposed in a microwave cavity and containing fill material therein responsive to microwave energy for emitting light therefrom, a method of mounting an optical reflector in said cavity comprising the steps of:

(a) forming a mesh pattern and a row of deformable portions through parts of a metal sheet to define a mesh section in said sheet;

(b) forming, from said sheet, an enclosure for said cavity, wherein the enclosure includes an optical transmission chamber;

(c) disposing said discharge envelope in said optical transmission chamber;

(d) securing an electrically non-conductive light reflector in said cavity to reflect said light into said optical transmission chamber enclosing said discharge envelope and bounded by said reflector and said mesh sections, said step of securing comprising the steps of;

(d.1) bending said deformable portions to project into said cavity and define a support plane for said reflector; and (d.2) placing the reflector in said cavity on said support plane in supported contact with said deformable portions.

16. The method of claim 15 wherein said deformable portions are tabs and wherein, in step (d), said tabs are bent at respective angles to contact a corresponding surface of said reflector.

* * * * *